United States Patent [19]

Polony et al.

[11] 4,111,844

[45] Sep. 5, 1978

[54] SYNERGISTIC MICROBICIDAL COMPOSITION

[75] Inventors: Rudolf Polony; Adolf Räuchle; Fritz Heizler, all of Basel, Switzerland

[73] Assignee: Ciba-Geigy Corporation, Ardsley, N.Y.

[21] Appl. No.: 747,565

[22] Filed: Dec. 6, 1976

[30] Foreign Application Priority Data

Dec. 15, 1975 [CH] Switzerland ..... 16278/75
Oct. 14, 1976 [CH] Switzerland ..... 13008/76

[51] Int. Cl.[2] ..... C11D 1/12; C11D 3/48

[52] U.S. Cl. ..... 252/106; 134/42; 252/550; 252/554; 252/557; 252/558; 424/340; 424/347

[58] Field of Search ..... 252/106, 550, 554, 557, 252/558; 134/42; 424/340, 347

[56] References Cited

U.S. PATENT DOCUMENTS

| | | | |
|---|---|---|---|
| 2,181,087 | 11/1939 | Caryl et al. | 252/557 |
| 2,607,359 | 8/1952 | Oesting | 134/30 |
| 3,506,720 | 4/1970 | Model et al. | 260/613 |
| 3,700,601 | 10/1972 | Bloching | 252/105 |
| 3,725,547 | 4/1973 | Kooistra | 424/245 |
| 3,753,914 | 8/1973 | Berth et al. | 252/95 |
| 3,794,587 | 2/1974 | Jungermann | 252/107 |
| 3,800,048 | 3/1974 | Model et al. | 424/304 |
| 3,925,227 | 12/1975 | Corey et al. | 252/106 |
| 3,970,576 | 7/1976 | Carmello et al. | 252/106 |

FOREIGN PATENT DOCUMENTS 1,602,077 11/1970 France.

OTHER PUBLICATIONS

Schwartz & Perry, "Surface Active Agents–Their Chemistry and Technology," Interscience Publ. Co., New York, 1949, pp. 452–458.

*Primary Examiner*—P.E. Willis, Jr.
*Attorney, Agent, or Firm*—Edward McC. Roberts; Michael W. Glynn; Prabodh I. Almaula

[57] ABSTRACT

Synergistic microbicidal compositions consisting of a halogenated o-hydroxydiphenyl ether and an anionic surfactant in a mixture ratio of 1:2 to 1:30 and optionally a solvent as well as a method of controlling microorganisms an organic and inorganic materials by treating said materials with the above mentioned compositions are described.

12 Claims, No Drawings

SYNERGISTIC MICROBICIDAL COMPOSITION

The present invention provides a synergistic microbicidal composition, a method of controlling microorganisms and of protecting organic and inorganic materials and objects from microorganisms, and a method of sterilising laundry goods and of protecting such articles against attackd by microorganisms.

It is known from U.S. Pat. Nos. 3,506,720 and 3,629,477 that halogenated o-hydroxydiphenyl ethers are suitable for controlling microoganisms, such as bacteria and phytopathogenic fungi. Similar agents are also known from DT-OS 2,351,386. It is also known from U.S. Pat. No. 3,616,256 that halogenated o-hydroxydiphenyl ethers are inactive against Pseudomonadeae.

This inactivity against Pseudomonadeae must be regarded as a great disadvantage of the halogenated o-hydroxydiphenyl ethers, which can otherwise be used as excellent microbicides. Great efforts have already been made to close this important gap in the microbicidal spectrum of these compounds. For example, a mixture of halogenated o-hydroxydiphenyl ethers and ethylenediaminetetraacetic acid (EDTA) and the salts thereof which can be added to different formulations, has been proposed in the German Offenlegungsschrift referred to above.

The surprising discovery has now been made that halogenated o-hydroxydiphenyl ethers of the formula

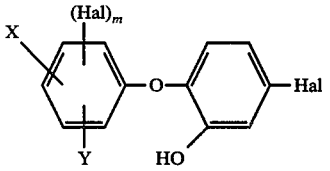

(I)

wherein

X represents a halogen atom, in particular a chlorine or bromine atom, a methyl, methoxy or hydroxyl group, Y represents a hydrogen atom, a methyl trifluoromethyl group, Hal represents a halogen atom, in particular a chlorine or bromine atom, and

*m* is 0, 1 or 2, have an excellent bactericidal action against Pseudomonadeae when they are used in combination with an anionic solubilising surfactant. Accordingly, the invention provides microbicidal compositions which contain a diphenyl ether of the formula (I) and an anionic solubilising surfactant.

The synergistic microbicidal compositions consist of a halogenated o-hydroxydiphenyl ether of the formula (I) and an anionic surfactant selected from the groups alkylsulphonates, alkylsulphates, triamine-alkylsulphates, alkylnaphthalenesulphonates and dialkylsulphosuccinates, in a mixture ratio of diphenyl ether: tenside of 1:2 to 1:30, and optionally a solvent, preferably water.

Those compositions which contain as diphenyl ether of the formula (I) one of the formula

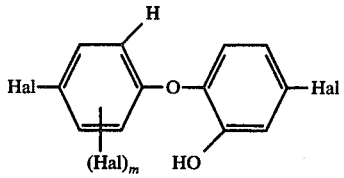

(II)

wherein Hal and *m* are as defined in formula (I), are characterised by an especially good activity.

Particularly preferred diphenyl ethers within the scope of the formula (II) are those of the formula

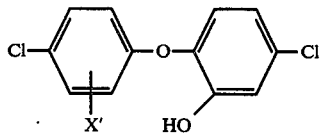

(III)

wherein X' represents a hydrogen atom or a chlorine atom.

The surfactants contained in the compositions of the present invention can be single compounds or also ordinary commercially available mixtures.

Suitable alkylsulphonates are preferably secondary alkylsulphonates containing 8 to 24, for example 10 to 18, carbon atoms, and mixtures thereof.

Alkysulphates, also called fatty alcohol sulphates, preferably have a chain length of 8 to 24, in particular 10 to 18, carbon atoms, for example lauryl sulphate. The chain length of the triamine-alkylsulphates is of the same order.

Alkylnaphthalenesulphonates preferably contain 2 to 18, in particular 3 to 12, carbon atoms in the alkyl moiety.

The alkyl groups in the dialkylsulphosuccinates preferably have chain lengths of 4 to 12, in particular 6 to 9, carbon atoms.

The solvent which, in addition to active substance and surfactant, may also be present in the compositions of the invention, is chiefly water, but can also be an alcohol, in particular a lower alcohol with an alcohol function and containing 1 to 4 carbon atoms, for example methanol or ethanol. It is also possible to use other conventional solvents in which active substance and surfactant are soluble and which do not impair the synergistic effect.

If a solvent is used, especially water, the concentrations of active substance of the formula (I) are between 20 and 50,000 ppm, preferably between 100 and 10,000 ppm.

The ratio of active substance and surfactant is 1:2 to 1:30, preferably 1:2 to 1:10 and depends on the surfactant employed. For example, when using alkylsulphates and alkylsulphonates it is preferably 1:2 to 1:10, when using trialkylamine-sulphates it is preferably 1:2 to 1:5, when using alkylnaphthalenesulphonates it is preferably 1:2 to 1:20, and when using dialkylsulphosuccinates it is preferably 1:3 to 1:10.

If the composition additionally contains water, then in a ratio of active substance: surfactant as just described above, the preferred concentrations of active substance for the individual mixtures are:

| surfactant | concentrations of active substance (in ppm) |
|---|---|
| alkylsulphate | 50–50,000 |
| alkylsulphonate | 50–30,000 |
| triamine-alkylsulphate | 100–50,000 |
| alkylnaphthalenesulphonate | 100–50,000 |
| dialkylsulphosuccinate | 200–20,000 |

The compositions of the present invention are as a rule colourless to slightly yellowish pastes or liquids. They are characterised by a low toxicity to warm-blooded animals and, in the suitable concentrations, are non-irritant to the eyes and skin. They are chiefly active against bacteria, but also exhibit a fungicidal action in the in vitro test. The bactericidal action extends both to gram-positive and to gram-negative bacteria, for example to staphyloccocae, for example *Staphylococcus aureus* SG 511, *Bacillus mesentericus,* Sarcina spec., to coli forms, such as *Escherichia coli* 96 and other gram-negative organisms, and most particularly to Pseudomonadeae, for example *Pseudomonas aeruginosa.*

The compositions of the invention are used for controlling microorganisms on organic and inorganic material and for protecting such material against attack by microorganisms. This use also constitutes an object of the invention.

Thus the compositions of the invention can be used for disinfecting and finishing laundry goods, for example surgical clothing, hospital linen, and for disinfecting a very wide variety of objects, for example in the medical sphere. Various surfaces, for example of metal, plastics, paint coatings etc., can be disinfected by the compositions of the invention. In this connection, floor coverings, carpets, walls and pieces of furniture, may be mentioned.

On account of their excellent tolerance by the skin, the compositions of the invention are also used for disinfecting the skin, in particular for hand hygiene.

Particular importance attaches to the compositions of the invention which contain water as solvent in the disinfection of laundry articles and in protecting laundry goods against attack by microorganisms.

The laundry goods which can be disinfected with the compositions of the invention are chiefly organic fibrous materials, viz. those of natural origin, such as cellulosic material, for example cotton, or polypeptide-containing material, for example wool or silk, or fibrous material of synthetic origin, for example that based on polyamide, polyacrylonitrile or polyester, or blends of the above fibres.

The compositions of the present invention render the laundry goods treated therewith substantially sterile to staphylococcus, coli and pseudomonas forms. A particular advantage of the compositions of the invention is moreover that the sterilisation, also from Pseudomonadeae, can be carried out at low temperatures and under mild conditions, since it is unnecessary to add further detrimental or environmentally harmful substances.

The compositions of the present invention are also very effective against the bacterial flora which give rise to perspiration odour, and are therefore, and on account of their low toxicity, suitable for use as deodorants for laundry articles or for cosmetics.

Examples of suitable o-hydroxydiphenyl ethers which can be used in the compositions of the invention are: 2',4'-dichloro-2-hydroxydiphenyl ether, $b.p._{12-13}$: 192°–196° C, 4,4'-dichloro-2-hydroxydiphenyl ether, m.p.: 78°–79° C, 4-chloro-4'-bromo-2-hydroxydiphenyl ether, m.p. 79°–80° C, 4-chloro-4'-fluoro-2-hydroxydiphenyl ether, m.p.: 77°–78° C, 4,3',4'-trichloro-2-hydroxydiphenyl ether, m.p.: 103°–104° C, 4,2',4'-trichloro-2-hydroxydiphenyl ether, m.p.: 60°–61° C, 4,2',4',5'-tetrachloro-2-hydroxydiphenyl ether, m.p. 147°–148° C, 4,4'-dichloro-3'-methyl-2-hydroxydiphenyl ether, m.p.: 118°–119° C, 4-bromo-4'-chloro-2-hydroxydiphenyl ether, $b.p._{13}$:214°–215° C, 4,4'-dibromo-2-hydroxydiphenyl ether, m.p.: 53°–54° C, 4-chloro-4'-methoxy-2-hydroxydiphenyl ether, $b.p._{13}$: 206°–211° C, 4,4'-dichloro-3'-trifluoromethyl-2-hydroxydiphenyl ether, m.p. 63°–65° C, 4-chloro-4'iodo-2-hydroxydiphenyl ether, m.p.: 86°–88° C, 4,2' -dichloro-2-hydroxydiphenyl ether, m.p.: 61°–62° C and 4-bromo-2',4'-dichloro-2-hydroxydiphenyl ether, $b.p._{12-13}$: 225°–229° C.

The following Examples illustrate the invention in more detail, the parts and percentages being by weight unless otherwise indicated.

A. Determination of the Bactericidal Action

The killing properties of the mixtures of the present invention are determined in the suspension test. Mixtures are prepared from 2,4,4'-trichloro-2'-hydroxydiphenyl ether and the respective surfactant in the ratio between 1:2 and 1:30 and dissolved in water so as to give stock solutions which contain 2,4,4'-trichloro-2'-hydroxydiphenyl ether in a concentration of 5 to 20%. Amounts of these stock solutions are then further diluted with water in order to obtain the respective desired concentration of 2,4,4'-trichloro-2'-hydroxydiphenyl ether. Then 5 ml of each of the solutions obtained are added to a suspension containing approx. $10^5$ bacteria (*Pseudomonas aeruginosa* NCTC 8060) per ml.

After specific intervals of time, a solid nutrient medium which contains a blocking agent (for example polyoxyethylene sorbitan monooleate) is inoculated with an amount of the mixture (e.g. 0.1 ml). The number of still living bacteria is determined.

The number of bacteria per ml determined after 15 seconds, 15 minutes, 1 hour and 4 hours are reported in Table 1. Those times (in hours) which are necessary to achieve a total kill of the pseudomonas bacteria are reported in Tables 2 to 7 as being exemplary for a number of 2,4,4'-trichloro-2'-hydroxydiphenyl ether/surfactant mixtures. No kill of the pseudomonas is observed if these tests are carried out with 2,4,4'-trichloro-2'-hydroxydiphenyl ether without the addition of the corresponding surfactant.

TABLE 1

| Concentration of HD* in ppm | Ratio of diphenyl ether:surfactant | Anionic surfactant | Exposure time number of bacteria/ml 15 sec. | 15 min. | 1 hour | 4 hours |
|---|---|---|---|---|---|---|
| 500 | 1:5 | sodium dioctyl-sulphosuccinate (for example the commerically available ®Alrowet D-65) | $1.10^3$ | $3.10^1$ | 0 | 0 |
| 200 | 1:3 | sodium laurylsulphate | $1.10^4$ | $3.10^1$ | $3.10^{-1}$ | 0 |
| 200 | 1:5 | sec. alkylsulphonate (for example the commerically | $4.10^3$ | $2.10^2$ | 0 | 0 |

TABLE 1-continued

| Concentration of HD* in ppm | Ratio of diphenyl ether:surfactant | Anionic surfactant | Exposure time number of bacteria/ml 15 sec. | 15 min. | 1 hour | 4 hours |
|---|---|---|---|---|---|---|
| | | available ®Mersolat W) | | | | |
| 500 | 1:3 | triamine laurylsulphate (for example the commercially available ®Steinapol TLS 90F) | $7.10^1$ | $6.10^{-1}$ | 0 | 0 |
| 500 | 1:3 | alkylnapthalenesulphonate (for example the commercially available ®Tinovetin B) | $2.10^3$ | $6.10^1$ | $1.10^{-1}$ | 0 |

HD = 2,4,4'-trichloro-2'-hydroxy-diphenyl ether

TABLE 2

Surfactant: sodium laurylsulphate

| Concentration of HD* in ppm | Ratio of HD:surfactant 1:2 | 1:3 | 1:5 | 1:10 |
|---|---|---|---|---|
| 100 | 4 | 4 | 4 | 4 |
| 200 | 4 | 4 | 1 | 1 |
| 500 | 4 | 1 | 0.25 | 1 |
| 1,000 | 0.25 | 0.25 | 0.25 | 1 |
| 2,000 | 0.25 | 0.25 | 0.25 | 1 |
| 5,000 | 0.25 | 0.25 | 1 | 24 |
| 10,000 | 1 | 1 | 1 | ** |
| 20,000 | 1 | 1 | 4 | ** |
| 30,000 | 1 | 24 | 24 | ** |
| 50,000 | 1 | 24 | 24 | ** |

*HD = 2,4,4'-trichloro-2'-hydroxydiphenyl ether
**No complete kill, only reduction in the number of bacteria

TABLE 3

Surfactant: sodium dicotylsulphosuccinate***

| Concentration of HD* in ppm | Ratio of HD : surfactant 1:3 | 1:5 | 1:10 |
|---|---|---|---|
| 200 | 4 | 1 | 4 |
| 500 | 4 | 1 | ** |
| 1,000 | ** | 1 | ** |
| 2,000 | ** | 1 | ** |

*HD = 2,4,4'-trichloro-2'-hydroxydiphenyl ether
**Reduction in the number of bacteria to approx. 1 to 5 per ml in 4 hours
***see Table 1

TABLE 4

Surfactant: triamine laurylsulphate***

| Concentration of HD* in ppm | Ratio of HD : surfactant 1:3 | 1:5 |
|---|---|---|
| 100 | 4 | 4 |
| 200 | 1 | 1 |
| 500 | 1 | 1 |
| 1,000 | 1 | ** |

*HD : 2,4,4'-trichloro-2'-hydroxydiphenyl ether
**Reduction in the number of bacteria to approx. 1 to 5 in 4 hours
***see Table 1

TABLE 5

Surfactant: secondary alkylsulphonate***

| Concentration of HD* in ppm | Ratio of HD : surfactant 1:2 | 1:3 | 1:5 | 1:10 |
|---|---|---|---|---|
| 200 | 4 | 4 | 1 | 4 |
| 500 | 4 | 4 | 1 | 4 |
| 1,000 | 4 | 4 | 1 | 4 |
| 2,000 | 4 | 4 | 1 | 4 |
| 5,000 | 4 | 4 | 1 | 4 |
| 10,000 | 4 | 4 | 4 | 4 |
| 20,000 | 4 | 4 | 4 | 4 |
| 30,000 | 4 | 4 | 4 | 4 |

*HD = 2,4,4'-trichloro-2'-hydroxydiphenyl ether
***see Table 1

TABLE 6

Surfactant: alkylnaphthalenesulphonate***

| Concentration of HD* in ppm | Ratio of HD : surfactant 1:2 | 1:3 | 1:5 | 1:10 | 1:20 | 1:20 |
|---|---|---|---|---|---|---|
| 100 | ** | ** | ** | 4 | 4 | 4 |
| 200 | ** | ** | 4 | 1 | 1 | 1 |
| 500 | ** | 4 | 1 | 0.25 | ** | ** |
| 1,000 | 1 | 4 | 1 | ** | ** | ** |
| 2,000 | 1 | 1 | ** | ** | ** | ** |

*HD = 2,4,4'-trichloro-2'-hydroxydiphenyl ether
**Reduction in the number of bacteria
***see Table 1

TABLE 7

Surfactant: secondary alkylsulphonate***

| Concentration of HD* in ppm | Ratio of HD : surfactant 1:2 | 1:3 | 1:5 | 1:10 |
|---|---|---|---|---|
| 200 | 4 | 4 | ** | 4 |
| 500 | 4 | 4 | 4 | 4 |
| 1,000 | 4 | 4 | 4 | 4 |
| 2,000 | ** | 4 | 4 | 4 |
| 5,000 | ** | 4 | 4 | 4 |
| 10,000 | ** | 4 | 24 | ** |
| 20,000 | ** | 4 | 24 | ** |
| 30,000 | ** | 4 | 24 | ** |

*HD = 2,4,4'-trichloro-2'-hydroxydiphenyl ether
**Reduction in the number of bacteria
***for example the commercially available ®Hostapur SAS 60

B. Application Examples

EXAMPLE 1

The following formulations are prepared:

(A)

8.0 g of 2,4,4'-trichloro-2'-hydroxydiphenyl ether,
40.0 g of sodium laurylsulphate,
52.0 g of demineralized water (B)

16.0 g of 2,4,4'-trichloro-2'-hydroxydiphenyl ether,
80.0 g of sodium dioctylsulphosuccinate,
4.0 g of dimineralized water (C)

10.0 g of 2,4,4'-trichloro-2'-hydroxydiphenyl ether,
30.0 g of secondary alkanesulphonate,
60.0 g of demineralized water (D)

11.5 g of 2,4,4'-trichloro-2'-hydroxydiphenyl ether,
38.5 g of triamine laurylsulphate,
50.0 g of demineralized water (E)

20.0 g of 2,4,4'-trichloro-2'-hydroxydiphenyl ether,
60.0 g of alkylnaphthalenesulphonate, 20.0 g of demineralized water These formulations are subsequently diluted with water so that the resultant liquor contains 100 to 500 mg of 2,4,4'-trichloro-2'-hydroxydiphenyl ether per liter. This liquor is then inoculated with Pseudomonadeae bacteria and a cotton fabric is washed therein at 30° to 40° C in a liquor ratio of 1:20 for 20 minutes.

The rinsed and dried fabric and the liquor exhibit a very pronounced reduction in the number of Pseudomonadeae bacteria.

EXAMPLE 2

The same formulations can be used for removing pseudomonas bacteria from wash fabric. The dilutions are prepared exactly as in application Example 1 and the liquor ratio can vary from 1:2 to 1:20. The textiles which are inoculated with pseudomonas bacteria are steeped in the treatment liquors. After 6 to 8 hours, the fabric and the liquors are free from pseudomonas bacteria.

The effects described in both Examples are not obtained by using 2,4,4'-trichloro-2'-hydroxydiphenyl by itself. After corresponding dilution, formulations similar to those described in application Example 1 can also be used for disinfecting articles of medical use, floors and articles of furniture and also the human skin, in particular the hands. In addition, a marked reduction or complete destruction of the bacteria present on the substrates, also of Pseudomonadeae, is achieved.

we claim:

1. A synergistic microbicidal composition consisting of (A) from about 20 to 50000 ppm, based on the weight of said composition, of 2, 4,4'-trichloro-2'-hydroxy diphenyl ether, (B) an anionic surfactant selected from the group consisting of alkylsulphonates, alkylsulphates, alkylnaphthalenesulphonates and dialkylsulphosuccinates and (C) water said component B being present in the composition at a ratio of A to B ranging from 1:2 to 1:30.

2. A microbicidal composition according to claim 1, in which the concentration of component A is 100 to 10000 ppm and the ratio of component A to component B is 1:2 to 1:10.

3. A microbicidal composition according to claim 2, consisting of component A in a concentration of 100 to 30000 ppm, a secondary alkylsulphonate as component B and water, the ratio of A to B ranging from 1:2 to 1:10.

4. A microbicidal composition according to claim 2, consisting of component A in a concentration of 50 to 50000 ppm, a lauryl sulphate as component B and water, the ratio of A to B ranging from 1:2 to 1:10.

5. A microbicidal composition according to claim 2, consisting of component A in a concentration of 100 to 50000 ppm, a triethanolamine laurylsulphate as component B and water, the ratio of A to B ranging from 1:2 to 1:5.

6. A microbicidal composition according to claim 2, consisting of component A in a concentration of 100 to 5000 ppm, an alkylnaphthalene sulphonate as component B and water, the ratio of A to B ranging from 1:2 to 1:20.

7. A microbicidal composition according to claim 2, consisting of component A in a concentration of 200 to 20000 ppm a dioctylsulphosuccinate as component B and water, the ratio of A to B ranging from 1:3 to 1:10.

8. A method of controlling microorganisms on organic and inorganic materials and of protecting said materials, which comprises treating these materials with a composition described in claim 1.

9. A method according to claim 8, which comprises the use of a composition described in claim 2.

10. A method according to claim 8, of disinfecting laundry goods and of protecting laundry goods against attack by microorganisms, which comprises treating textile fibres and textiles with a composition described in claim 1.

11. A method according to claim 8 of disinfecting articles of medical use, which comprises treating said articles with a composition described in claim 1.

12. A method according to claim 8 of disinfecting hands, which comprises washing the hands with a composition described in claim 1.

* * * * *